US007814691B2

(12) United States Patent
Thimm

(10) Patent No.: US 7,814,691 B2
(45) Date of Patent: Oct. 19, 2010

(54) USE OF LEFT-HANDED METAMATERIALS AS A DISPLAY, PARTICULARLY ON A HOB, AS WELL AS DISPLAY AND DISPLAY METHOD

(75) Inventor: Wolfgang Thimm, Karlsruhe (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 776 days.

(21) Appl. No.: 11/750,563

(22) Filed: May 18, 2007

(65) Prior Publication Data

US 2007/0267406 A1 Nov. 22, 2007

(30) Foreign Application Priority Data

May 18, 2006 (DE) ..... 10 2006 024 097

(51) Int. Cl.
*G09F 9/00* (2006.01)

(52) U.S. Cl. ..... 40/449

(58) Field of Classification Search ..... 40/449; 116/204; 219/622; 359/280
See application file for complete search history.

(56) References Cited

U.S. PATENT DOCUMENTS

| | | | | |
|---|---|---|---|---|
| 5,499,597 | A * | 3/1996 | Kronberg | 116/216 |
| 6,828,530 | B2 | 12/2004 | Boegel et al. | |
| 6,859,114 | B2 | 2/2005 | Eleftheriades et al. | |
| 6,963,259 | B2 | 11/2005 | Killen et al. | |
| 7,515,330 | B2 * | 4/2009 | Bratkovski | 359/328 |
| 2003/0111460 | A1 | 6/2003 | Boegel et al. | |
| 2004/0000976 | A1 | 1/2004 | Killen et al. | |
| 2008/0043475 | A1 * | 2/2008 | Bernkopf | 362/326 |
| 2008/0296710 | A1 * | 12/2008 | Tonucci | 257/421 |

FOREIGN PATENT DOCUMENTS

| | | |
|---|---|---|
| DE | 296 05 163 | 8/1996 |
| DE | 10 2004 033 454 A1 | 1/2006 |
| DE | 10 2005 025 896 A1 | 11/2006 |
| DE | 10 2005 025896 | 11/2006 |

OTHER PUBLICATIONS

Elhuyar Fundazioa; Left-handed Metamaterials: Cheaper Mobile Phone or GPS and With Enhanced Performance: Science Daily; Nov. 30, 2005; pp. 1-4; web address: http://www.sciencedaily.com/releases/2005/11/051130092536.htm.

(Continued)

*Primary Examiner*—Joanne Silbermann
*Assistant Examiner*—Christopher E Veraa
(74) *Attorney, Agent, or Firm*—Alston & Bird LLP

(57) ABSTRACT

Coatings with left-handed metamaterials (which are man-made materials comprising micro-structures having unusual electro-magnetic properties) are provided around an appliance, such as a hotplate or hob, incorporating induction heating coils that functions as an optical display. In one embodiment, operation of induction heating coils in the cook top alters the optical properties of the metamaterial. Thus, if the metamaterials were previously transparent, they can now become opaque. Doing so changes a display, which can be detected by an operator. This makes it possible to create an automatic operating display for an appliance, such as an induction based hob.

13 Claims, 2 Drawing Sheets

OTHER PUBLICATIONS

Metamaterial; Wikipedia; pp. 1-6; http://en.wikipedia.org/wiki/Negative_refractive_index.

True Left-Handed Metamaterials; Nanotechnology Research Center Bilkent University; http://www.nanotechnologybikent.edu.tr.

Zharov et al., Nonlinear Properties of Left-Handed Metamaterials, Physical Review Letters, Jul. 18, 2003, vol. 91, No. 3, pp. 037401-1-037401-4, The American Physical Society.

German Application No. 10 2006 024 097.9, dated May 18, 2006.

Enkrich et al., Magnetic Metamaterials at Telecommunication and Visible Frequencies, Physical Review Letters, Nov. 11, 2005, pp. 203901-1-203901-4, The American Physical Society.

German Search Report from German Application No. 10 2006 024 097.9.

European Search Report from European Application No. EP 07 00 9565.

* cited by examiner

USE OF LEFT-HANDED METAMATERIALS AS A DISPLAY, PARTICULARLY ON A HOB, AS WELL AS DISPLAY AND DISPLAY METHOD

RELATED APPLICATIONS

This application claims priority to German Patent Application No. 10 2006 024 097.9 filed on May 18, 2006 2007, the contents of which are incorporated by reference.

FIELD OF APPLICATION

The invention relates to the use of left-handed metamaterials for use in a display, for example, on an electrical appliance such as a hob (cook top) or the like, as well as a corresponding display and display method.

PRIOR ART

U.S. Pat. No. 6,828,530 discloses an apparatus for marking an induction coil. LEDs are placed around an induction coil on a hob and are electrically supplied by coils, in which when operating the induction coil, a voltage is induced. This makes it possible to implement an automatic operating display for the induction heating coil.

It is known from German patent DE 10 2005 025 896 A1 to provide on a hob plate areas or materials having different optical transmission properties. Thus, it is possible to implement both an operating or a "hot display" indicator, and optionally also a temperature indicator. It is also disclosed to use thermochromic material on a hob. Thermochromic material changes colour as a function of its temperature and is consequently suitable as a hot display on a hob. Inter alia, a description is also given to the effect that photon crystals can be provided in the hob plate or a coating of a hob plate. They also have advantages for temperature evaluation with IR-radiation.

PROBLEM AND SOLUTION

One embodiment of the present invention is to provide the aforementioned use, a display and a display method, which makes it possible to avoid the disadvantages of the prior art and in particular enabling a display using materials, which change their optical properties in the case of a targeted action.

BRIEF DESCRIPTION OF THE DRAWINGS

Embodiments of the invention are described in greater detail hereinafter relative to the attached diagrammatic drawings, wherein show.

DETAILED DESCRIPTION OF THE EMBODIMENTS

Figure 1:
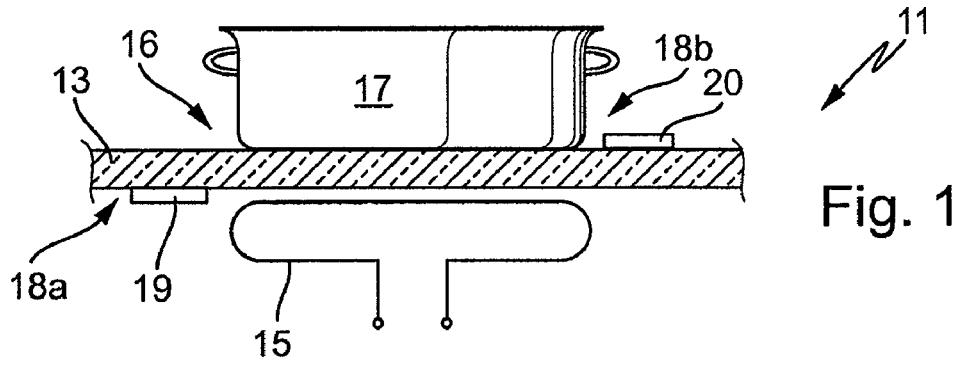
FIGS. 1 to 3 Alternative constructions of an induction hob with induction heating coil and a display having metamaterials.

This problem is solved by one embodiment by the features of claim 1, a display according to claim 13, and a display method according to claim 22. Advantageous and preferred developments of the invention are given in the further claims and are explained in greater detail hereinafter. Some of the following features are only referred to once. However, independently thereof, they can apply to all the variants. By express reference the wording of the claims is made into part of the content of the description.

Left-handed metamaterials are used as a display or in display means. The latter are in particular useful for a function or information display, for example on an electrical appliance, such as an electrical cooking appliance, such as hobs or ovens. The left-handed metamaterials are present in the form of a coating or at least a thin plate, positioned close or directly on at a housing wall or cover of the display or electrical appliance. According to one embodiment of the invention, a switchable or controllable induction means, or so-called magnetizing means, is provided in the vicinity of said left-handed metamaterials. They are in particular constituted by an induction coil, which can be switched on and off particularly easily. The precise construction of such metamaterials can be gathered from the article "Nonlinear properties of left-handed metamaterials", Physical Review Letters, volume 91, number 3, 03740-1 to 037401-4 or the article "Magnetic metamaterials at Telecommunication and visible Frequencies", Physical Review Letters, PRL 95, 203901-1 to 203901-4.

The starting materials for the metamaterials can be, for example, copper and gold, in each case involve structures in a range smaller than 10 μm. It is also possible to use ferroelectrics such as $Ba_xSr_{1-x}TiO_3$. Further information in this connection is provided in U.S. Pat. Nos. 6,963,259 or 6,859,114, which are incorporated by reference into the present specification by express incorporation by reference. When selecting the materials, it must be borne in mind that no materials may be contained that, as a result of magnetic induction, have a self-heating such that they damage or even destroy themselves or the metamaterials, (e.g., this applies to certain metals, such as nickel).

Such metamaterials make it possible when applying or modifying a magnetic field in whose range of effectiveness they are located, to change the optical properties in such a way that they, for example, change from an opaque state to a transparent state.

Due to the changing magnetic field of the magnetizing means or induction means, the metamaterial is influenced or affected in such a way that its optical properties change. This can either apply to their transmittance properties, i.e. their transmission, or can apply to their reflection properties, i.e. reflection. It can also apply to the colouring properties. In conjunction with the structure of the display in this way said "optical switching" can be visible or made visible for an operator, so as to implement the display function. Reference is made thereto in greater detail hereinafter. Reference will also be made to the precise way in which the magnetic field change can be brought about.

In one embodiment of the invention, the metamaterials are placed on the display in such a way that they are directly visible. Thus, the operator can directly detect the change to the optical properties or the modified optical appearance. One possibility is placing under a cover or panel, which is substantially transparent, for example made from transparent glass or plastic. However, another possibility involves placing the metamaterials on a cover, housing wall or panel. This gives independence of the optical properties of the actual cover, because the metamaterials or their optical appearance change are in any case visible. Thus, it is also possible to use an opaque cover.

According to a further embodiment of the invention, the metamaterials can be positioned upstream of lighting means or upstream of an illuminated display and can cover the same.

In this case, the metamaterials are looked upon as a type of panel, which for example conventionally covers the lighting means or ensures that they are not visible. On applying the magnetic field or modifying the optical properties thereof, the metamaterial becomes transparent and thus the light source become visible. This makes it possible to implement a display function for an operator.

According to an alternative development of the invention the metamaterials can be positioned behind light source, or a display. Then, use is made of reflecting properties, which can be modified as a function of a magnetic field. It can be possible for a display to be visible to an operator when the metamaterials or a coating comprising the same reflects through the application of a magnetic field.

In a further development of the invention the metamaterials can be positioned in the manner of a coating or the like under a substantially transparent cover. Although they are not necessarily visible, on changing their optical properties towards the reflecting ambient light, they can reflect back through the cover that this can be perceived in clear form as a display by an operator. As in the other cases, the metamaterials can be in the form of symbols or indicia, representing the same as a display.

Coils are advantageously used as induction means or magnetizing means. A particularly advantageous possibility is provided by an induction coil under a cover. This is advantageously could be an induction heating coil in the case of an induction cook top. The metamaterials are then in the range of effectiveness of the induction heating coil, if an object to be heated, particularly a cooking vessel, is placed on the cover. The metamaterials are then particularly advantageously outside the induction heating coil in such a way that expectedly they are outside the object to be heated, so that they are still visible. However, they should not be too far from the induction heating coil, so that the magnetic field, which can be achieved, is still adequately strong for the desired action or change to the optical properties.

A further advantage of these metamaterials is that they have an increased thermal stability compared with displays using LED. They can therefore be positioned closer to a heating device, for example a radiant heater for a hob.

In another advantageous embodiment of the invention, the metamaterials are arranged in ring-like manner around the induction heating coil or along its ring-like contour. Advantageously, they are at a limited distance from the induction heating coil. This limited distance should not exceed a few centimeters so that, as described hereinbefore, the magnetic field is still sufficiently strong. They can form a substantially closed ring. It is advantageously possible here, particularly in the case of use in an induction hob, for the metamaterials to be applied as a ring-like coating to the top or bottom of the hob surface and in this way they are clearly visible in accordance with the previously described embodiments.

As an alternative to induction means or magnetizing means provided in fixed form on the display, it is possible when attaching a magnetic control element, particularly according to U.S. Pat. No. 5,920,131, for it to produce the magnetic field for modifying the metamaterials. If such a control element is applied at an intended location for the subsequent control or operation of the electrical appliance, its readiness to operate can be indicated by a varying display as a result of the varying optical properties of the metamaterials.

These and further features can be gathered from the claims, description and drawings and the individual features, both singly or in the form of subcombinations, can be implemented in an embodiment of the invention and in other fields and can represent advantageous, independently protectable constructions for which protection is claimed here. The subdivision of the application into individual sections and the subheadings in no way limit the general validity of the statements made thereunder.

FIG. 1 shows an induction hob 11, which in the manner of a conventional induction hob, has a hob plate 13 below which is located an induction heating coil 15. The size of the latter defines a hotplate 16 on which a cooking vessel 17 in the form of a saucepan is placed. The diameters of the induction heating coil 15, hotplate 16 and cooking utensil 17 roughly coincide, or should coincide, for an optimum heating of the cooking vessel 17 or its contents.

There is also a display 18*a* or 18*b* according to the invention. Although they are jointly shown here, in practice only one is present. Display 18*a* has a coating 19 with a left-handed metamaterial, as described hereinbefore. The lower coating 19 is located on the underside of a hob plate 13, namely somewhat outside or adjacent to the surface corresponding to the extension of the induction heating coil 15 or hotplate 16. It can admittedly also extend further towards the centre of the induction heating coil 15. However, as can be gathered from FIG. 1, when the cooking vessel 17 is in place, i.e., when operating the induction hob 11, it is covered by the cooking vessel 17 and no longer visible, so that it would scarcely serve any purpose.

Correspondingly display 18*b* has an upper coating 20 also made from, or incorporating, left-handed metamaterial. As shown, it is also appropriately located outside or adjacent to hotplate 16. Apart from the aforementioned reasons, a part is also played here by the fact that as a function of the mechanical stability of the coating the cooking vessel 17 is then less frequently placed on coating 20 and consequently the latter is less likely to be damaged, scratched or removed.

Coatings 19 and 20 are shown with an exaggerated thickness in FIG. 1. This is certainly not necessary in practice and coating thicknesses of 1 mm or less are considered adequate. This more particularly applies to the upper coating 20, because here an increased thickness would become prejudicially noticeable.

Further details are given hereinafter relative to FIGS. 2 to 4 concerning the design of coatings 19 and 20. However, it is pointed out that, as stated hereinbefore, the coatings of left-handed metamaterials, i.e., coatings 19 and 20, can be constructed in random form, i.e., both as simple surfaces and as symbols, letters, etc.

FIG. 1 does not show the precise path of the magnetic field when operating the induction heating coil 15. When the cooking vessel 17 is in place, i.e., when the induction heating coil 15 is in operation for a longer time period, most of the magnetic field is focussed into the bottom of the cooking vessel. However, at the edge, i.e., where the coatings 19 and 20 are located, there is a sufficiently strong magnetic field or stray field, in order to bring about the aforementioned change to the optical properties of the left-handed metamaterials.

Figure 2:
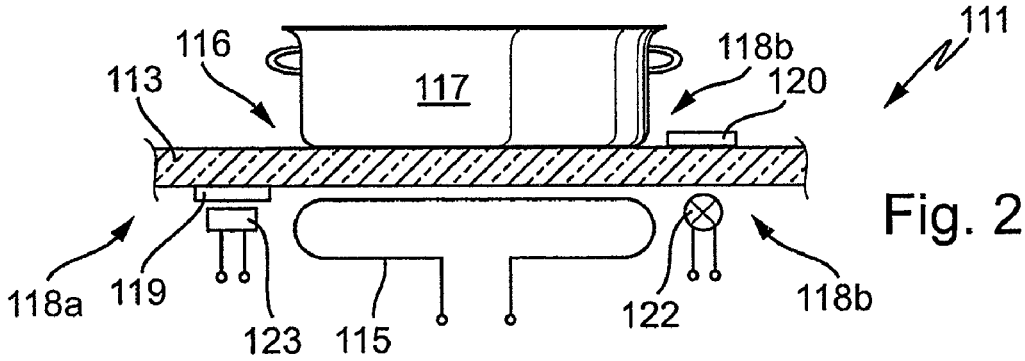
Figure 3:
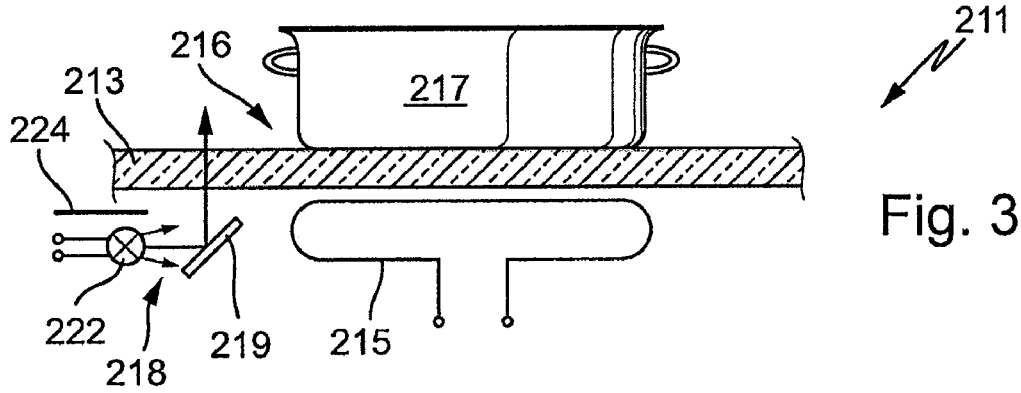

FIG. 2 shows a further induction hob 111 in a modified form. Once again a cooking vessel 117 is placed on a hotplate 116 of a hob plate 113 with induction heating coil 115. Once again there are two displays 118*a* and 118*b*, as in FIG. 1. However, here further display means are located under the same. Under the lower coating 119 is provided a known seven-segment display 123. Under the right-hand, upper coating 120 is positioned a simple lighting means 122, for example, a single LED, glow lamp, etc.

In the further variant according to FIG. 3, once again there is an identical induction hob 211 with a display 218 in the form of a lower coating 219 with left-handed metamaterial. It is inclined in such a way that it is illuminated by lighting means 222 positioned to the left thereof and which is upwardly shielded by shield 224 and is consequently not visible in the active state and the light beam path is deflected upwards through the hob plate 213.

The displays 18 shown in FIGS. 1 to 3 function as follows. In FIG. 1 on switching on the induction heating coil 15, there is a change to the optical behaviour of coatings 19 and 20. If, for example, without a magnetic field they were transparent or translucent, they are now opaque or detectable as a coating or symbol. Whereas the upper coating 20 is in the direct field of vision, it is necessary to have a substantially transparent hob plate for detecting a lower coating 19, i.e., below said hob plate. Particularly in the case of an induction hob, it can be made from hardened glass and has the necessary physical properties. Thus, through the hob plate 13, it is possible to detect the change of state of coating 19 and this can be conceived as a display function.

In the case of the displays 118 according to FIG. 2, coatings 119 and 120 shield illuminated displays. Whereas in the case of FIG. 1 for representing the operation of the induction heating coil the coatings have changed their optical properties from transparent to opaque, this takes place completely differently in FIG. 2. The otherwise non-transparent coatings 119 and 120 become transparent or light-permeable on operating the induction heating coil 115 with the magnetic field which arises. As a result, the underlying lighting means 122 or seven-segment display 123 become visible as a display for an operator. In the case of coating 120, it is possible for either the construction of coating 120 or some other masking not only to represent a light spot produced by the lighting means 122, but also a specific symbol.

In the operation of the display 218 according to FIG. 3, the coating 219 is again non-reflecting when the induction heating coil 215 is in the deactivated state. If it is influenced during its operation by the magnetic field of the induction heating coil 215, it changes its optical properties and becomes reflecting. Thus, the light of lighting means 222 in accordance with the beam course shown, is reflected upwards and is detectable for an operator as an operating display for hotplate 216.

Further constructions of displays with coatings of left-handed metamaterials can easily be implemented by the expert on the basis of the above information. Moreover, apart from the three types described, further state changes of the metamaterials under the action of a magnetic field can be used for display purposes.

Figure 4:
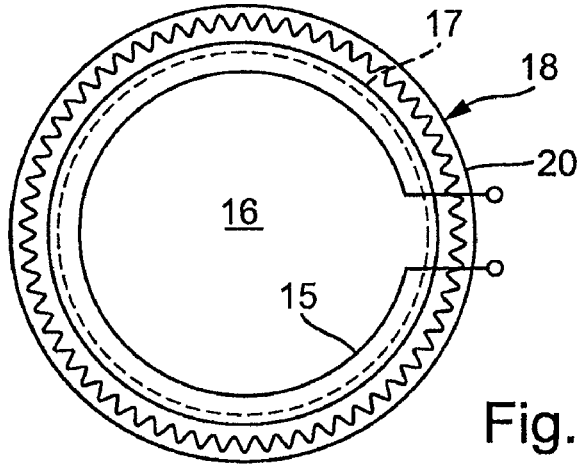
FIG. 4 A plan view of the induction hob of FIG. 1.

In FIG. 4 in a plan view of the induction hob 11 according to FIG. 1, it is shown how the upper coating 20 is formed as a closed ring around hotplate 16 or a cooking vessel 17. If the induction heating coil 15 is operated, in the manner described hereinbefore, coating 20 changes its optical properties, for example becoming opaque or changes its colour or reflectivity. This can be detected by an operator as a display 18, particularly because coating 20 is applied to the top of hob plate 13. As stated hereinbefore, the left-hand, lower coating 19 according to FIG. 1 can also be constructed in ring-like form as a display.

Figure 5:
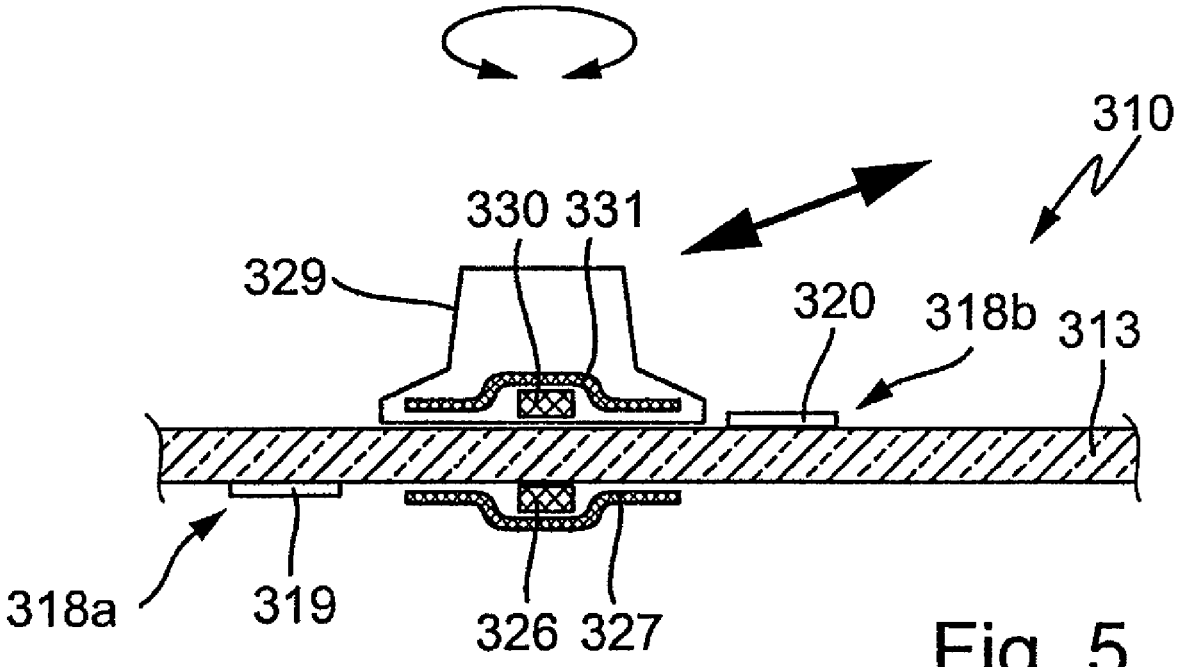
FIG. 5 An operating or control device with a removable magnetic rotary toggle and a display similar to FIG. 1.

A further embodiment is shown in FIG. 5 as an operating device 310, which is constructed according to the principle disclosed in U.S. Pat. No. 5,920,131. In this respect, express incorporation by reference the contents of said document is made into part of the present description. On a cover or housing wall 313, either lower coatings 319 or upper coatings 320 with said left-handed metamaterials are provided, once again in a random or flat form. A lower magnet 326 with lower magnet star 327 is provided below cover 313.

Facing the fixed magnet 326 is defined a point on which can be applied a removable rotary toggle 329 for operation or inputting instructions. Said rotary toggle 329 contains a central magnet 330 together with the associated upper magnet star 331. If, in accordance with U.S. Pat. No. 5,920,131, rotary toggle 329 is positioned above the lower magnet 326 for a subsequent rotary operation, the magnetic field produced by it gives rise to the aforementioned changes in coatings 319 or 320. Thus, in much the same way as when putting into operation the induction heating coil in the preceding embodiments, they change their optical properties within the scope of all the aforementioned possibilities and consequently also form a display 318*a* or 318*b*.

However, in this embodiment it must be borne in mind that it is not the magnetic field of the lower magnet 326, with lower magnet star 327, which brings about the change to the optical properties in coatings 319 and 320; this is only brought about through the application of rotary toggle 329. However, this can be easily implemented by one skilled in the art, for example by additional shields around the lower magnet 326 or magnet star 327. Additionally, in the outer area of rotary toggle 329, further magnets can be provided, for example for displaying a specific rotary position, similar to an optical marking, at a specific point of the rotary toggle. On a ring passing round the rotary toggle 329 similar to FIG. 4, by rotating said toggle and magnets fixed to the outside thereof, a jointly moving area of modified optical properties can be produced in coating 319 or 320. This indicates to an operator the rotary movement, such as would be conventionally shown by a projecting arrowhead or the like.

The invention claimed is:

1. A display for use as a function display or information display on an electrical appliance, said display having a housing wall, said display having left-handed metamaterials attached to it wherein said metamaterials are formed as a coating and positioned close to said housing wall, wherein a switchable magnetizing source is provided and positioned close to said metamaterials.

2. A display according to claim 1, wherein said metamaterials are in the form of a thin plate.

3. A display according to claim 1, wherein said switchable magnetizing source is constituted by an induction coil.

4. A display according to claim 1, wherein said housing wall has a transparent cover and said metamaterials are placed in a visible manner on said display under said transparent cover.

5. A display according to claim 4, wherein said metamaterials are placed under said transparent cover as reflecting means for reflecting ambient light back through said cover.

6. A display according to claim 1, wherein said housing wall has a cover and said metamaterials are placed in a visible manner on said display on said cover.

7. A display according to claim 1, wherein said display has a lighting source and said metamaterials are placed upstream of said lighting source and cover said lighting source.

8. A display according to claim 1, wherein said magnetizing source is placed under a cover of said housing wall with a range of effectiveness to detect an object to be heated placed on said cover, said range of effectiveness embracing said metamaterials.

9. A display according to claim 8, wherein said metamaterial are placed in a ring-like manner around said magnetizing source with a spacing of a three of less centimeters.

10. A method for displaying information to a user of an electrical appliance having a display, wherein said display comprises left-hand metamaterials applied to a cover wherein the left-handed metamaterials undergo modification of optical properties by application of a magnetic field, comprising the steps of:

creating a magnetic field adjacent to said metamaterials wherein said magnetic field is adjacent to said metamaterials.

11. A method for displaying information according to claim 10, further comprising the step of:

the user moving a magnet to said metamaterials thereby creating the magnetic field.

12. A method for displaying information according to claim 11, wherein said said user moving said magnet to said metamaterials takes place by positioning a movable control element comprising said magnet at a position provided for said control element on said electrical appliance.

13. A method for displaying information according to claim 10 wherein the step of creating a magnetic field is accomplished by switching on an induction coil.

* * * * *